US006434358B1

(12) United States Patent
Maul et al.

(10) Patent No.: US 6,434,358 B1
(45) **Date of Patent: *Aug. 13, 2002**

(54) OIL SECRETING SUPPLY ROLLER FOR AN ELECTROPHOTOGRAPHIC PRINTER, INCLUDING A METHOD FOR APPLYING A TONER REPELLING SUBSTANCE TO A FUSER ROLLER

(75) Inventors: Michael David Maul; Edward Alan Rush, both of Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,855

(22) Filed: Dec. 13, 2000

(51) Int. Cl.[7] ..... G03G 15/20
(52) U.S. Cl. ..... 399/325
(58) Field of Search ..... 399/324, 325, 399/326

(56) References Cited

U.S. PATENT DOCUMENTS

| | | | | | |
|---|---|---|---|---|---|
| 3,964,431 | A | * | 6/1976 | Namiki | 399/325 X |
| 5,030,976 | A | | 7/1991 | Salmon | 347/117 |
| 5,274,428 | A | | 12/1993 | Wong et al. | 399/300 |
| 5,482,552 | A | * | 1/1996 | Kikukawa et al. | 399/325 X |
| 5,788,770 | A | | 8/1998 | Hobson et al. | 118/244 |
| 5,853,832 | A | * | 12/1998 | Ishikawa | 399/325 X |
| 6,195,526 | B1 | * | 2/2001 | Lee et al. | 399/325 X |
| 6,212,355 | B1 | * | 4/2001 | Bunn et al. | 399/325 |
| 6,249,657 | B1 | * | 6/2001 | Kagawa | 399/67 |
| 6,266,509 | B1 | * | 7/2001 | Ota et al. | 399/325 |

FOREIGN PATENT DOCUMENTS

| | | | |
|---|---|---|---|
| JP | 62-44754 | * | 2/1987 |
| JP | 4-139477 | * | 5/1992 |

* cited by examiner

*Primary Examiner*—Fred L. Braun
(74) *Attorney, Agent, or Firm*—Kilpatrick Stockton, LLP

(57) ABSTRACT

A fuser oil supply roller including an oil impregnated rubber roller and an outer metering layer of known fluid transfer characteristics for an electrophotographic printer fuser. The roller allows silicone oil to be secreted from the metering layer onto a fuser hot roller to prevent toner from adhering to the fuser hot roller, as well as serving to provide a smooth toner surface. Such a roller provides oil to the fuser hot roller without the need for a separate oil reservoir and delivery system. Therefore, a precisely metered supply of oil is provided to the fuser hot roller while reducing complexity and moving parts. A buffer layer is also provided for minimizing the roller volume given to the oil impregnated rubber roller. A barrier layer may be employed to prevent oil migration into the buffer layer. Furthermore, methods for applying a toner repelling substance to a fuser roller are provided.

47 Claims, 2 Drawing Sheets

OIL SECRETING SUPPLY ROLLER FOR AN ELECTROPHOTOGRAPHIC PRINTER, INCLUDING A METHOD FOR APPLYING A TONER REPELLING SUBSTANCE TO A FUSER ROLLER

BACKGROUND OF THE INVENTION

Electrophotographic processes such as that used in printers, copiers, and fax machines produce hardcopy images on a print media such as paper through precise deposition of toner onto the print media. The toner is applied by the print mechanism to correspond to the desired text or image to be produced. Such toner is then permanently affixed to the media by a fuser, which heats the toner such that it melts and bonds to the print media.

Typically the fuser comprises at least two contiguous rollers, a hot roller and a backup roller. The media is transported to the print mechanism and passes between the contiguous rollers, such that fuser hot roller heats the media to melt and fuse the toner to the print media.

As the toner melts, it becomes tacky and has a tendency to adhere to the fuser hot roller. Over time, toner accumulates on the hot roller, and eventually on the backup roller, causing degradation of the image quality on the print media.

Application of a lubricating substance to the fuser hot roller serves to weaken the bond between the toner and the hot roller and prevents accumulation of toner on the hot roller, and also serves to smooth the toner surface. Silicone oil is one such lubricating substance which has effective toner repelling properties. Alternatively, such oil can be applied to the backup roller, and then transferred to the fuser hot roller due to rotational engagement of the backup roller with the fuser hot roller.

There are a variety of prior art oil delivery systems to apply silicone oil to the fuser hot roller. Oil webs, oil wicking systems, and oil delivery rolls have been employed to provide a controlled supply of oil to the hot roller. Such prior art mechanisms, however, increase the complexity of the system by adding moving parts, and increase maintenance because of the need to maintain a supply of silicone oil. Further, as such oil delivery systems tend to promote a continuous oil flow, an idle period between printing cycles can result in a surge of oil, called an oil dump, during a successive print phase. Such oil dumps can compromise the finished print quality, and further can damage the printer if excess oil leaks onto other components.

One prior art oil delivery system is shown in FIG. 1, in which an oil web 10 extends from a web supply roll 14 to a web take-up roll 12. The web is generally a fabric material of one or more layers and is held in contact with the fuser hot roller 18 by one or more biasing rollers 16. Oil delivery is controlled by indexing the web 10 by controlled rotation of the take-up and supply rolls 12 and 14. While effective at delivering oil, such an oil delivery system generally increases the number of moving parts, affecting cost and maintenance.

Another prior art oil delivery system is shown in FIG. 2, which utilizes a wicking element 20 biased against the fuser hot roller 18 by a spring loaded or other biasing member 22 mounted on a support 23, or otherwise disposed in contact with the fuser hot roller. The wicking element is a piece of fibrous textile or mesh material adapted to transport silicone oil through capillary action. As the wicking element extends from an oil reservoir 24 to the hot roller 18, the wicking element is therefore adapted to deliver silicone oil along the length of the fuser hot roller 18. Such a system, however, tends to be prone to oil dumps due to the capillary characteristic of the wicking element material, and further requires a separate oil reservoir 24 to be maintained.

FIGS. 3*a* and 3*b* show prior art oil delivery rolls. Such rolls utilize an outer metering layer wrapped around an oil containing center. FIG. 3*a* shows a web wrapped roll 34, which includes an oil saturated wrapping 30 such as a temperature resistant paper or non-woven material around a support shaft 36. An outer metering layer 38, such as felt or a metering membrane, is wrapped around the oil saturated wrapping to limit the flow of oil brought to the surface by the capillary action of the oil saturated wrapping. FIG. 3*b* shows a tank-type oil roll which uses a hollow support shaft 44 as an oil reservoir. The hollow support shaft has oil delivery holes 46 along the length for delivering oil to a metering material 42, such as rolled fabric, which is wrapped around the hollow support shaft 44. Each of these oil delivery rolls shown in FIGS. 3*a* and 3*b* rotationally engage the fuser hot roller for the purpose of applying oil. Such an oil delivery roll, however, requires periodic replenishment of the oil reservoir and can also result in oil dumps if the oil delivery roll remains in contact with the fuser hot roller during idle periods.

An oil impregnated rubber roller for an electrophotographic printer fuser allows silicone oil to secrete from the rubber roller onto the fuser hot roller to prevent toner from adhering to the fuser hot roller. Such an oil impregnated roller provides oil delivery to the fuser hot roller without the need for a separate oil reservoir and delivery system. The oil impregnated roller decreases the potential for large surges of oil onto the print media, while continuing to provide a controlled delivery of oil to the fuser hot roller.

Such an oil impregnated roller is comprised of a cylindrically shaped silicone rubber roller disposed around a rotatable shaft. The silicone oil is impregnated into the silicone rubber roller during the rubber manufacturing process, rather than saturated or injected by a secondary process following manufacturing.

The secretion rate of the oil from the oil impregnated roller to the fuser hot roller is affected primarily by the viscosity of the silicone oil and the rotational speed of the rollers. The viscosity of the oil tends to decrease with increased temperature. Accordingly, the silicone oil impregnated in the roller is selected to be of a viscosity which secretes at a desired flow rate at the operating temperature of the fuser hot roller. A greater flow rate can be achieved by decreasing the viscosity of the silicone oil selected. Further, as the fuser hot roller generally cools during idle periods, the oil viscosity increases and therefore flows less freely; thus the oil impregnated roller can remain in contact with the fuser hot roller for extended idle periods without increasing the potential for oil dumps.

As the secretion rate of the silicone oil is most affected by the viscosity of the oil, a larger quantity of impregnated silicone oil does not substantially increase the flow of oil. Therefore, the flow rate tends to remain consistent regardless of the quantity of oil remaining impregnated in the roller. Accordingly, a large quantity of oil can be impregnated in the silicone rubber, thereby increasing longevity of the oil impregnated roller without affecting the flow rate or increasing the potential for oil dumps.

It would be beneficial, therefore, to develop an oil delivery system which reduces the number and complexity of moving parts, avoids the maintenance of an oil reservoir, and which avoids the tendency for oil dumps, while still providing a carefully metered supply of oil to the fuser hot roller.

BRIEF SUMMARY OF THE INVENTION

An oil secreting roller comprised of a plurality of layers, one of which is comprised of a homogenous, oil secreting substance. A metering membrane layer, such as expanded polytetrafluorethylene (PTFE), felt, or paper, is wrapped around the cylindrical roller element to further limit and control the amount of oil exuded. Also, the oil secreting cylindrical roller element may be disposed around an inner silicone rubber layer or other inner buffer layer to minimize swelling, since the oil secreting portion may have a tendency to swell, depending on the type of oil used, the type of rubber used, or the operating temperature. Finally, a barrier layer such as VITON® may be provided between the inner buffer layer and the oil secreting cylindrical roller element to minimize diffusion of the silicone oil into the inner buffer layer.

A cleaning element such as a cleaner roller, wiper, web, or scraper can be provided in contact with the hot roller or a roller engaged directly or indirectly therewith to remove excess toner, dust or other particles which may accumulate on the roller surfaces.

BRIEF DESCRIPTION OF THE SEVERAL VIEWS OF THE DRAWING

The invention as disclosed herein will be more fully understood by the following detailed description and drawings, of which.

DETAILED DESCRIPTION OF THE INVENTION

Figure 1:
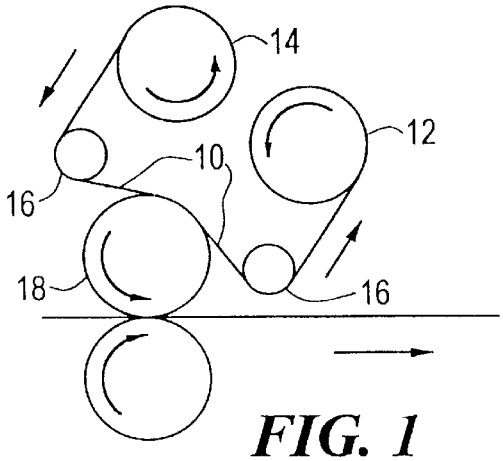
FIG. 1 PRIOR ART
FIG. 1 shows a prior art oil web system.
Figure 2:
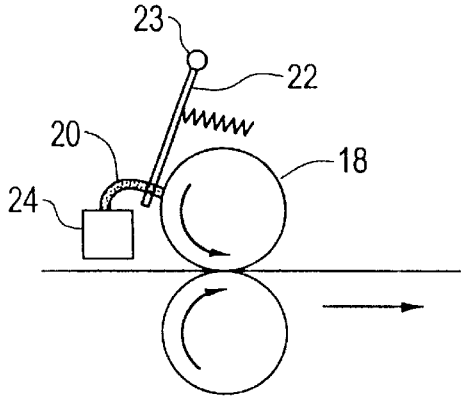
FIG. 2 PRIOR ART
FIG. 2 shows a prior art oil wicking system.
Figure 3A:
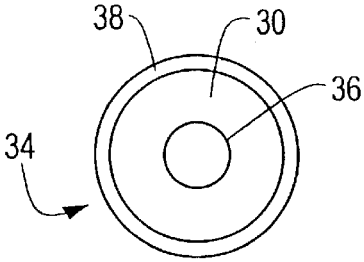
FIG. 3a PRIOR ART
FIG. 3*a* a shows a web wrap type of oil delivery roll.
Figure 3B:
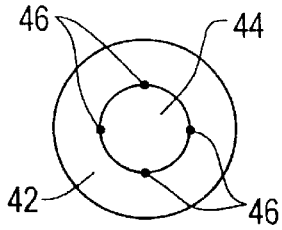
FIG. 3b PRIOR ART
FIG. 3*b* shows an oil reservoir type of oil delivery roll.
Figure 4A:
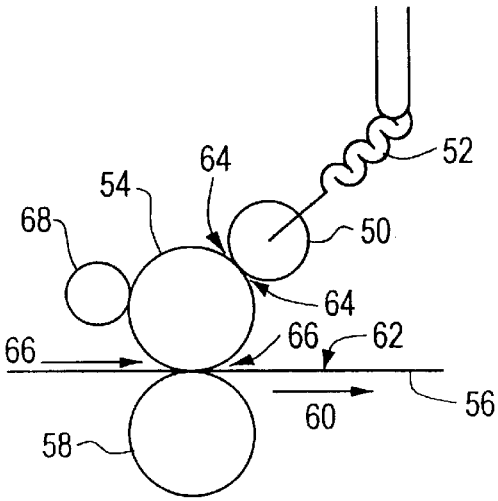
FIG. 4*a* shows an oil delivery system as defined by the present invention.
Figure 4B:
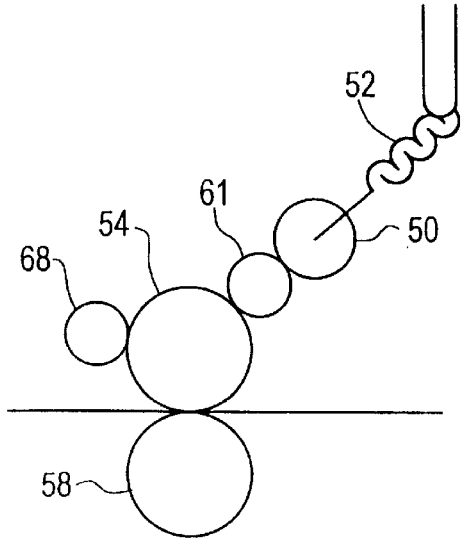
FIG. 4*b* shows an oil delivery system as defined by the present invention utilizing an indirect donor roll.

An oil impregnated roller as defined by the present invention may be employed in direct rotational engagement with the fuser hot roller, or in indirect engagement through a donor roller. Referring to FIGS. 4*a* and 4*b*, oil delivery systems utilizing direct and indirect oil impregnated roller engagement, respectively, as defined herein are shown. The oil impregnated roller 50 is rotatably mounted on a resilient mounting 52 in rotational engagement with the fuser hot roller 54. Resilient mounting 52 is biased to keep the oil impregnated roller 50 against the fuser hot roller 54 and to maintain rotational engagement therewith.

Fuser hot roller 54 is rotated to advance print media 56, disposed between the fuser hot roller and a backup roller 58, in the direction shown by media path 60 via frictional contact with the fuser hot roller. Alternatively, print media could be advanced by alternate drive mechanisms, such as conveyor belts or trays. Toner deposited on a media surface 62 of the print media 56 is then melted and fused by the fuser hot roller 54 as the print media 56 passes in contact therewith.

As fuser hot roller 54 is rotated in contact with the oil impregnated roller 50, silicone oil or other toner repelling substance is secreted out of the oil impregnated roller onto the fuser hot roller at an oil secretion point 64. As the fuser hot roller continues to rotate with the oil, such oil tends to prevent melted toner residue and unfused toner from adhering to the fuser hot roller as it contacts the print media 56 at a toner fuser position 66, and also serves to provide a smooth toner surface on the print media. Accordingly, accumulation of unused toner on the fuser hot roller is prevented.

A cleaner roller 68, in rotational communication with fuser hot roller 54, may be used to eliminate accumulation of unfused toner and dust on the fuser hot roller. As small amounts of unfused toner and extraneous matter such as dust may adhere to the fuser hot roller, cleaner roller 68 absorbs such matter. Cleaner roller 68 is typically comprised of a fibrous or mesh textile substance. As silicone oil serves to weaken the bond between toner and the fuser hot roller, this excess toner is easily absorbed by the cleaner roller 68.

Alternatively, cleaner roller 68 may also be implemented as a wiper, scraper, or web, as long as a fibrous or abrasive surface adapted to remove extraneous matter is brought in contact with the fuser hot roller. Further, such contact may be direct or indirect, as the cleaner roller may be located in contact with other rollers, as long as such a cleaner roller is in direct or indirect rotational communication with the fuser hot roller.

FIG. 4*b* shows a similar roller orientation using a donor roll. The donor roll 61 is disposed between and in rotational engagement with both the oil impregnated roller 50 and the fuser hot roller 54. Oil is therefore secreted from the oil roll 50 onto the donor roll 61, and subsequently applied to the fuser hot roller 54. Such a donor roll can serve to allow optimal oil roll placement for maintenance and service access, and also to isolate the oil roll from the heat of the fuser to further prevent oil dumps. Other embodiments employ direct and indirect application of oil to the fuser hot roller 54 through various roller arrangements. Various support structures and motors for the rollers are known to those skilled in the art. Such alternate applications are effective at providing a controlled quantity of oil to the fuser hot roller as long as the oil impregnated roller is in rotational engagement with the fuser hot roller.

Figure 5:
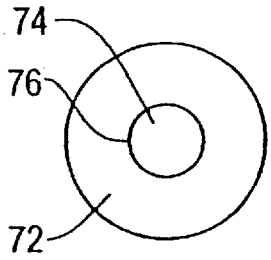
FIG. 5 PRIOR ART
FIG. 5 shows a cross section of a prior art oil impregnated roller.

FIG. 5 shows a cross section of the oil impregnated roller as defined by the prior art. A cylindrical formation of oil impregnated silicone rubber 72 has a center bore 76 therethrough. A rotatable support shaft 74 is disposed through the center bore 76 to drive the oil impregnated roller. The oil impregnated silicone rubber 72 may be secured to the rotatable support shaft 74 by any suitable means, such as by frictional fitting or adhesive.

Such an oil impregnated silicone rubber 72 is formed by impregnating the oil during the silicone rubber manufacturing process. A preferred oil impregnated silicone rubber 72 is made by Dow Corning under the trademark Silastic S50508-Oil Exuding Grade. As mentioned above, the secretion rate of the oil is affected primarily by the viscosity of the oil. As the viscosity of the oil varies with temperature, such oil is selected for the viscosity at the normal operating temperature of the fuser hot roller. Secretion flow rates for several oil impregnated silicone rubber materials under different operating conditions are shown in Table 1.

TABLE 1

| Sample | % Quantity Impregnated | Average Per Page | After 30 Min. Idle | After Idle Overnight |
|---|---|---|---|---|
| 1 | 2% | 0.1475 mg | 0.05 mg | 0.1 mg |
| 2 | 18% | 0.182 mg | 0.76 mg | 0.55 mg |
| 3 | 2% | 0.168 mg | 0.55 mg | 0.69 mg |

Quantity Impregnated refers to the percentage of the roller which is impregnated oil. Average Per Page refers to the quantity of oil deposited onto a sheet during normal operation at a normal fuser operating temperature. After 30 Min. Idle refers to the first page following such an idle cycle. After Idle Overnight refers to the first page following an overnight idle period, typically expected to be about 15 hours. The quantity of oil secreted should be less than 1.0 mg per page to reduce the potential for duplex defects from excessive oil in the electrophotographic process. Further, the print media begins to have a moist appearance when the oil quantity approaches the range of 5.0 mg–10.0 mg per page, depending on the toner used.

The quantity of oil impregnated in the silicone rubber, rather than the secretion rate, tends to affect the longevity of the oil impregnated roller. Accordingly, the secretion rate tends to remain consistent until the quantity of oil remaining impregnated in the oil impregnated roller decreases past a minimum threshold, at which point substantially all the impregnated oil has been secreted. One advantage provided by the fact that viscosity, rather than quantity, tends to drive the secretion rate is that since the fuser cools during idle periods, the viscosity of the oil increases during these periods, resulting in a reduced secretion rate. Even after an overnight idle period, the quantity of oil is small enough to allow the oil impregnated roller to remain in rotational engagement without compromising print quality through oil dumps. Accordingly, no retraction mechanism to disengage the oil impregnated roller is required.

Despite the advantages achieved through the use of such an oil impregnated roller 72, the secretion rate of the oil may be non-uniform about the circumference of an individual roller, and may also vary from roller to roller. As such, it is preferred to employ an element which minimizes these characteristics.

Figure 6:
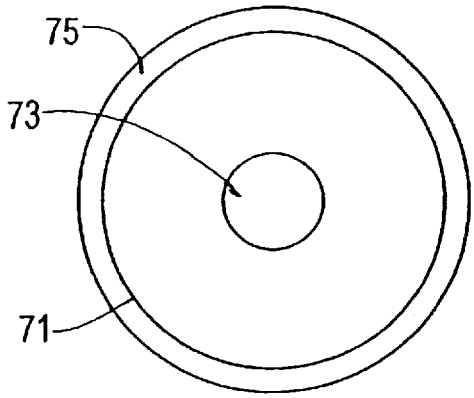
FIG. 6 shows an oil impregnated roller having a metering layer as defined by the present invention.

Referring to FIG. 6, an embodiment of an oil impregnated roller as defined by the present invention is shown. A cylindrical roller element 71 comprised of an oil secreting substance such as silicone rubber is disposed around a support shaft 73. A metering layer 75, such as expanded PTFE, felt, or other suitable metering membrane, is wrapped around cylindrical roller element 71 to control the secretion rate of the silicone oil and improve the uniformity of silicone oil coverage. Expanded PTFE may be fabricated in a controlled fashion such that the resulting porosity is tightly controlled. Consequently, oil secreted from a silicone rubber layer is exuded through a metering layer in an even, controlled fashion.

Figure 7:
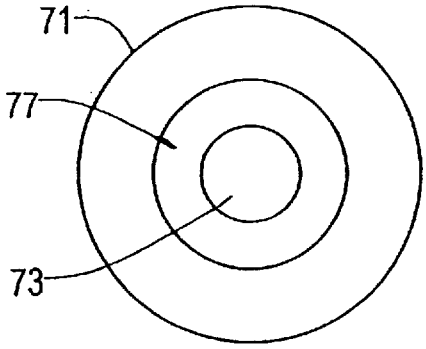
FIG. 7 shows an oil impregnated roller having an inner buffer layer as defined by the present invention.

As the silicone oil or other toner repelling substance impregnated in the cylindrical roller element 71 may have a tendency to cause the impregnated substance to swell, precise spacing tolerances and tensions within the fuser mechanism can be affected. Accordingly, FIG. 7 shows another embodiment of the oil impregnated roller in which an inner buffer layer 77 is disposed around the support shaft 73. The cylindrical roller element 71 is then formed by providing a coating of oil impregnated silicone rubber around the inner buffer layer 77. Preferably, the inner buffer layer does not absorb the oil from the oil impregnated roller. In this manner, the volume of the oil impregnated roller which comprises the oil secreting cylindrical roller element is thereby reduced. Swelling and velocity variations due to the consumption of oil are thus minimized.

Figure 8:
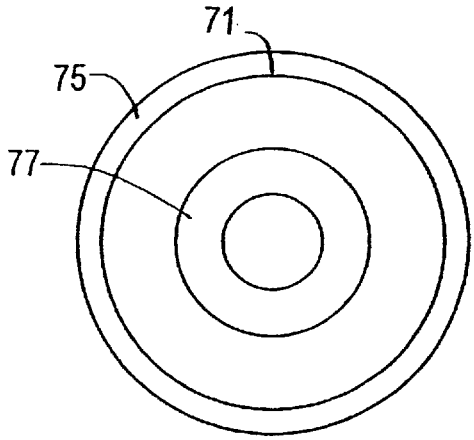
FIG. 8 shows an oil impregnated roller having an inner buffer layer and a metering layer as defined by the present invention.
Figure 9:
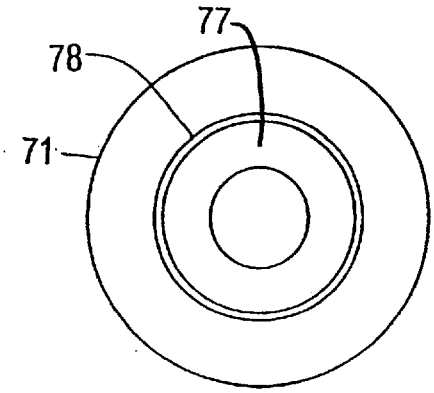
FIG. 9 shows an oil impregnated roller having an inner buffer layer and a barrier layer as defined by the present invention.
Figure 10:
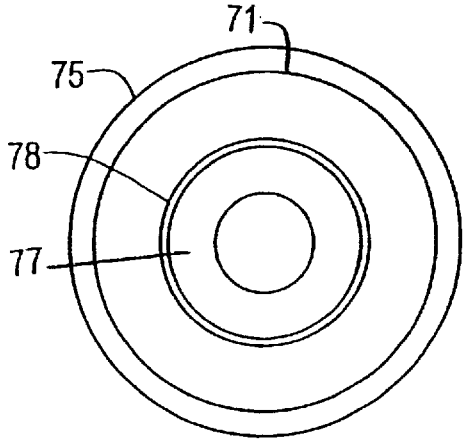
FIG. 10 shows an oil impregnated roller having an inner buffer layer, barrier layer, and metering layer.

FIG. 8 introduces another embodiment of the oil impregnated roller comprising both the metering layer 75 and the inner buffer layer 77. However, as the inner 15 buffer layer 77 may be comprised of a substance similar to that of the cylindrical roller element 71, diffusion of silicone oil from the oil impregnated cylindrical roller element 71 into the inner buffer layer 77 may occur. A barrier layer 78 may therefore be employed between the inner buffer layer 77 and the cylindrical roller element 71, as shown in FIGS. 9 and 10, to prevent inward diffusion and further minimize swelling of the oil impregnated roller. Such a barrier layer may be employed alone (FIG. 9), or with the metering layer 75 (FIG. 10). 25 A suitable material for such a barrier layer 78 includes TEFLON® and any other non-porous, thin material.

As various extensions and modifications to the embodiments disclosed herein may be apparent to those skilled in the art, particularly with regard to alternate arrangements of rollers, the present invention is not intended to be limited except by the following claims.

What is claimed is:

1. A fuser oil supply roller for an electrophotographic printer comprising:

a rotatable drive shaft;

a cylindrical roller element concentrically disposed around said rotatable drive shaft, said cylindrical roller element impregnated with a toner repelling substance and adapted for controlled secretion of said toner repelling substance upon contact with a fuser roller, said rotatable drive shaft being operable to provide rotational engagement of said cylindrical roller element with said fuser roller, said fuser roller for fusing toner to printed media; and a metering layer disposed about said cylinder roller element, said metering layer adapted to provide controlled transfer of said toner repelling substance onto said fuser roller, wherein said toner repelling substance is substantially uniformly distributed throughout said cylindrical roller element such that said toner repelling substance is applied onto said fuser roller at a predetermined rate.

2. The fuser oil supply roller of claim 1 wherein said cylindrical roller element is comprised of a homogeneous substance.

3. The fuser oil supply roller of claim 2 wherein said homogeneous substance is silicone rubber.

4. The fuser oil supply roller of claim 1 wherein said toner repelling substance is silicone oil.

5. The fuser oil supply roller of claim 1 wherein said toner repelling substance is secreted from said cylindrical roller element at a substantially constant rate until a minimum quantity of toner repelling substance remains impregnated in said cylindrical roller element.

6. The fuser oil supply roller of claim 1 wherein said metering layer is PTFE.

7. The fuser oil supply roller of claim 1 further comprising an inner buffer layer disposed between said rotatable drive shaft and said cylindrical roller element.

8. The fuser oil supply roller of claim 7 further comprising a barrier layer between said inner buffer layer and said cylindrical roller element, wherein said barrier layer is impervious to said toner repelling substance.

9. The fuser oil supply roller of claim 1 wherein said toner repelling substance is secreted at a rate inversely proportional to the viscosity of said toner repelling substance.

10. The fuser oil supply roller of claim 9 wherein said rate of secretion of said toner repelling substance averages about 0.148 mg per page to 0.182 mg per page when said cylindrical roller element is actively applying said toner repelling substance at a normal operating temperature for said electrophotographic printer.

11. The fuser oil supply roller of claim 9 wherein said rate of secretion following a period of idle time of about 15 hours is between 0.10 mg per page to 0.69 mg per page.

12. The fuser oil supply roller of claim 9 wherein said rate of secretion during an idle time of approximately 30 minutes is about 0.05 mg per page to 0.55 mg per page.

13. The fuser oil supply roller of claim 1 wherein said cylindrical roller element is comprised of an oil impregnated silicone rubber.

14. The fuser oil supply roller of claim 1 wherein said fuser roller is comprised of a fuser hot roller for fusing toner to said print media.

15. The fuser oil supply roller of claim 14 wherein said rotational engagement between said fuser hot roller and said cylindrical roller element is direct physical engagement with said fuser hot roller.

16. The fuser oil supply roller of claim 14 wherein said rotational engagement between said fuser hot roller and said cylindrical roller element is indirect physical engagement with said fuser hot roller.

17. The fuser oil supply roller of claim 16, said fuser roller further comprising at least one donor roller wherein said indirect rotational engagement between said fuser hot roller and said cylindrical roller element is via said at least one donor roller.

18. A fuser oil supply roller for an electrophotographic printer comprising:

a rotatable drive shaft;

a cylindrical roller element concentrically disposed around said rotatable drive shaft, said cylindrical roller element impregnated with a toner repelling substance and adapted for controlled secretion of said toner repelling substance upon contact with a fuser roller, said rotatable drive shaft being operable to provide rotational engagement of said cylindrical roller element with said fuser roller, said fuser roller for fusing toner to printed media; and an inner buffer layer disposed between said rotatable drive shaft and said cylindrical roller element, wherein said toner repelling substance is substantially uniformly distributed throughout said cylindrical roller element such that said toner repelling substance is applied onto said fuser roller at a predetermined rate.

19. The fuser supply roller of claim 18 further comprising a barrier layer between said inner buffer layer and said cylindrical roller element, wherein said barrier layer is impervious to said toner repelling substance.

20. The fuser oil supply roller of claim 18 wherein said cylindrical roller element is comprised of a homogeneous substance.

21. The fuser oil supply roller of claim 19 wherein said homogeneous substance is silicone rubber.

22. The fuser oil supply roller of claim 18 wherein said toner repelling substance is silicone oil.

23. The fuser oil supply roller of claim 18 wherein said toner repelling substance is secreted from said cylindrical roller element at a substantially constant rate until a minimum quantity of toner repelling substance remains impregnated in said cylindrical roller element.

24. The fuser oil supply roller of claim 18 further comprising a metering layer disposed about said cylindrical roller element, said metering layer adapted to provide controlled transfer of said repelling substance onto said fuser roller.

25. The fuser oil roller of claim 24 wherein said metering layer is PTFE.

26. The fuser oil supply roller of claim 18 wherein said toner repelling substance is secreted at a rate inversely proportional to the viscosity of said toner repelling substance.

27. The fuser oil supply roller of claim 26 wherein said rate of secretion of said toner repelling substance averages about 0.148 mg per page to 0.182 mg per page when said cylindrical roller element is actively applying said toner repelling substance at a normal operating temperature for said electrophotographic printer.

28. The fuser oil supply roller of claim 26 wherein said rate of secretion following a period of idle time of about 15 hours is between 0.10 mg per page to 0.69 mg per page.

29. The fuser oil supply roller of claim 26 wherein said rate of secretion during an idle time of approximately 30 minutes is about 0.05 mg per page to 0.55 mg per page.

30. The fuser oil supply roller of claim 18 wherein said cylindrical roller element is comprised of an oil impregnated silicone rubber.

31. The fuser oil supply roller of claim 18 wherein said fuser roller is comprised of a fuser hot roller for fusing toner to said print media.

32. The fuser oil supply roller of claim 31 wherein said rotational engagement between said fuser hot roller and said cylindrical roller element is direct physical engagement with said fuser hot roller.

33. The fuser oil supply roller of claim 31 wherein said rotational engagement between said fuser hot roller and said cylindrical roller element is indirect physical engagement with said fuser hot roller.

34. The fuser oil supply roller of claim 33, said fuser roller further comprising at least one donor roller wherein said indirect rotational engagement between said fuser hot roller and said cylindrical roller element is via said at least one donor roller.

35. The fuser oil supply roller of claim 18 further comprising a metering layer disposed about said cylinder roller element, said metering layer adapted to provide controlled transfer of said toner repelling substance onto said roller.

36. The fuser oil supply roller of claim 35 wherein said metering layer is PTFE.

37. A toner fuser apparatus for an electrophotographic printer comprising:

a fuser backup roller;

a fuser hot roller in rotational engagement with said fuser backup roller and adapted for fusing toner to print media passed therebetween; and a fuser oil supply roller in rotational engagement with said fuser hot roller, wherein said fuser oil supply roller further comprises:

a cylindrical roller element concentrically disposed around a rotatable drive shaft, said cylindrical roller element impregnated with a toner repelling substance and adapted for controlled secretion of said toner repelling substance upon said rotational engagement with said fuser hot roller; and a metering layer, disposed about said cylindrical roller element, adapted for providing a controlled transfer of said toner repelling substance onto said fuser hot roller, said rotatable drive shaft being operable to provide said rotational engagement of said fuser oil supply roller with said fuser hot roller.

38. A toner fuser apparatus for an electrophotographic printer comprising:

a fuser backup roller;

a fuser hot roller in rotational engagement with said fuser backup roller and adapted for fusing toner to print media passed therebetween; and a fuser oil supply roller in rotational engagement with said fuser hot roller, wherein said fuser oil supply roller further comprises:

a rotatable drive shaft;

a buffer layer concentrically disposed about said drive shaft;

a cylindrical roller element concentrically disposed around said buffer layer, said cylindrical roller element impregnated with a toner repelling substance and adapted for controlled secretion of said toner repelling substance upon said rotational engagement with said fuser hot roller, said rotatable drive shaft being operable to provide said rotational engagement of said fuser oil supply roller with said fuser hot roller.

39. The toner fuser apparatus of claim 38, wherein said fuser oil supply roller further comprises a barrier layer, substantially impervious to said toner repelling substance, between said cylindrical roller element and said buffer layer.

40. A method of applying a toner repelling substance to a fuser hot roller comprising the steps of:

impregnating silicone rubber with said toner repelling substance, wherein said toner repelling substance is adapted to be secreted from said silicone rubber;

forming a cylindrical roller element having a center bore therethrough from said impregnated silicone rubber;

forming an oil impregnated roller by disposing a rotatable drive shaft through said center bore;

covering said oil impregnated roller with a metering layer having a predetermined oil transfer rate therethrough;

disposing said covered, oil impregnated roller in rotational communication with a fuser hot roller;

rotating said covered, oil impregnated roller in coordination with rotation of said fuser hot roller such that said secreted toner repelling substance is applied onto said fuser hot roller.

41. The method of claim 40 wherein said step of impregnating further comprises impregnating said silicone rubber with silicone oil.

42. The method of claim 40 wherein said step of disposing comprises disposing said covered, oil impregnated roller in direct communication with said fuser hot roller.

43. The method of claim 40 wherein said step of disposing comprises disposing said covered, oil impregnated roller in indirect communication with said fuser hot roller.

44. A method of applying a toner repelling substance to a fuser hot roller comprising the steps of:

impregnating silicone rubber with said toner repelling substance, wherein said toner repelling substance is adapted to be secreted from said silicone rubber;

forming a buffer roller by disposing a substantially cylindrical section of buffer material about a cylindrical roller;

forming a cylindrical roller element having a center bore therethrough from said impregnated silicone rubber;

forming an oil impregnated roller by disposing said cylindrical roller element about said buffer roller;

disposing said oil impregnated roller in rotational communication with a fuser hot roller; and rotating said oil impregnated roller in coordination with rotation of said fuser hot roller such that said secreted toner repelling substance is applied onto said fuser hot roller.

45. The method of claim 44 wherein said step of impregnating further comprises impregnating said silicone rubber with silicone oil.

46. The method of claim 44 wherein said step of disposing comprises disposing said oil impregnated roller in direct communication with said fuser hot roller.

47. The method of claim 44 wherein said step of disposing comprises disposing said oil impregnated roller in indirect communication with said fuser hot roller.

* * * * *